US010593347B2

(12) United States Patent
Baek et al.

(10) Patent No.: US 10,593,347 B2
(45) Date of Patent: Mar. 17, 2020

(54) METHOD AND DEVICE FOR REMOVING NOISE USING NEURAL NETWORK MODEL

(71) Applicant: SAMSUNG ELECTRONICS CO., LTD., Suwon-si, Gyeonggi-do (KR)

(72) Inventors: Soon Ho Baek, Seoul (KR); Han Gil Moon, Daejeon (KR); Ki Ho Cho, Gunpo-si (KR); Gang Youl Kim, Suwon-si (KR); Jin Soo Park, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/933,756

(22) Filed: Mar. 23, 2018

(65) Prior Publication Data

US 2018/0286425 A1 Oct. 4, 2018

(30) Foreign Application Priority Data

Mar. 31, 2017 (KR) ..... 10-2017-0041972

(51) Int. Cl.
*G10L 25/30* (2013.01)
*G10L 21/0232* (2013.01)
*G10L 21/0216* (2013.01)

(52) U.S. Cl.
CPC ..... *G10L 25/30* (2013.01); *G10L 21/0232* (2013.01); *G10L 2021/02166* (2013.01)

(58) Field of Classification Search
CPC ..... G10L 25/30; G10L 21/0232; G10L 2021/02166; G10L 25/84; G10L 25/51
See application file for complete search history.

(56) References Cited

U.S. PATENT DOCUMENTS

| | | | | |
|---|---|---|---|---|
| 6,449,594 | B1 * | 9/2002 | Hwang | G10L 15/20 704/231 |
| 7,472,059 | B2 * | 12/2008 | Huang | G10L 25/93 704/220 |
| 9,286,897 | B2 * | 3/2016 | Bisani | G10L 15/08 |
| 9,299,347 | B1 * | 3/2016 | Siohan | G10L 15/02 |
| 9,666,184 | B2 * | 5/2017 | Lee | G10L 15/16 |
| 9,972,339 | B1 * | 5/2018 | Sundaram | G10L 17/04 |
| 10,032,463 | B1 * | 7/2018 | Rastrow | G10L 15/183 |
| 10,381,020 | B2 * | 8/2019 | Ramprashad | G10L 21/0208 |

(Continued)

OTHER PUBLICATIONS

Xu et al., "An Experimental Study on Speech Enhancement Based on Deep Neural Networks", IEEE Signal Processing Letters, vol. 21, No. 1, Jan. 2014, 4 pages.

(Continued)

*Primary Examiner* — Mohammad K Islam
(74) *Attorney, Agent, or Firm* — Nixon & Vanderhye P.C.

(57) ABSTRACT

A portable electronic device includes an audio input device and a processor. The processor is configured to obtain audio input data including a noise signal having an audio feature through the audio input device, to filter the audio input data using a neural network model to generate first audio output data, and to filter the first audio output data without using the neural network model to generate second audio output data. The first audio output data has a first changed audio feature corresponding to the audio feature and the second audio output data has a second changed audio feature corresponding to the audio feature.

8 Claims, 11 Drawing Sheets

(56) References Cited

U.S. PATENT DOCUMENTS

| | | | | |
|---|---|---|---|---|
| 2007/0078649 | A1* | 4/2007 | Hetherington | G10L 21/0216 704/226 |
| 2007/0083365 | A1* | 4/2007 | Shmunk | G10L 21/0272 704/232 |
| 2014/0324745 | A1* | 10/2014 | Leppanen | G06K 9/6254 706/12 |
| 2016/0078880 | A1 | 3/2016 | Avendano et al. | |
| 2016/0093313 | A1 | 3/2016 | Vickers | |
| 2016/0275964 | A1* | 9/2016 | Kim | G10L 15/20 |
| 2016/0284346 | A1* | 9/2016 | Visser | G10L 15/16 |
| 2017/0018272 | A1* | 1/2017 | Lee | H04N 21/4394 |
| 2017/0092268 | A1* | 3/2017 | Kristjansson | G10L 15/20 |
| 2017/0110117 | A1* | 4/2017 | Chakladar | G10L 15/063 |
| 2017/0194020 | A1* | 7/2017 | Miller | G10L 25/51 |
| 2017/0236510 | A1* | 8/2017 | Fuchiwaki | G10L 15/22 704/251 |
| 2017/0243579 | A1* | 8/2017 | Hwang | G10L 15/02 |
| 2017/0249955 | A1* | 8/2017 | Jiang | G06N 3/02 |
| 2017/0263266 | A1* | 9/2017 | Henrique Barbosa Postal | G10L 25/51 |
| 2018/0040333 | A1* | 2/2018 | Wung | G10L 21/0232 |
| 2018/0277134 | A1* | 9/2018 | Goodwin | G10L 21/0208 |

OTHER PUBLICATIONS

Xu et al., "A Regression Approach to Speech Enhancement Based on Deep Neural Networks", IEEE/ACM Transactions on Audio, Speech, and Language Processing, vol. 23, No. 1, Jan. 2015, 13 pages.

* cited by examiner

METHOD AND DEVICE FOR REMOVING NOISE USING NEURAL NETWORK MODEL

CROSS-REFERENCE TO RELATED APPLICATION

This application is based on and claims priority under 35 U.S.C. § 119 to Korean Patent Application No. 10-2017-0041972, filed on Mar. 31, 2017, in the Korean Intellectual Property Office, the disclosure of which is incorporated by reference herein its entirety.

BACKGROUND

1. Field

The present disclosure relates to a technology that removes noise using a neural network model.

2. Description of Related Art

With the development of a technology to remove noise, an electronic device equipped with an algorithm such as a deep neural network has been widely distributed. The electronic device may remove noise from an audio signal input to the electronic device using the above-described algorithm. For example, the electronic device may train the deep neural network such that the audio signal is mapped to the noise-free voice signal. The electronic device may remove noise from the audio signal using the trained deep neural network.

The electronic device may remove the noise based on statistical characteristics of the noise. For example, the statistical characteristics of the noise may not be changed with time. Accordingly, the electronic device may estimate the power spectral density (PSD) of the noise in the silent interval and may remove the noise from the audio signal assuming that the estimated value corresponds to the noise.

In a method of removing a noise by mapping an audio signal and a voice signal to a noise-free voice signal using a deep neural network, the noise removal efficiency may vary depending on the type and size of the noise. For example, the noise removal efficiency may be reduced in a noise environment that is not used for deep neural network learning.

If a method of removing noise based on the statistical characteristics of the noise is applied to the noise that is difficult to estimate the PSD, the efficiency may be reduced. For example, it may be difficult to estimate the silent interval in a noise environment in which the statistical characteristic varies with time (e.g., music, babble) or in a noise environment in which a signal to noise ratio (SNR) is remarkably low. In this case, it may be difficult for the electronic device to estimate the PSD, and thus the noise removal efficiency of the electronic device may be reduced.

SUMMARY

Aspects of the present disclosure address at least the above-mentioned problems and/or disadvantages and to provide at least the advantages described below. Accordingly, an aspect of the present disclosure is to provide an electronic device and a user terminal device.

In accordance with an aspect of the present disclosure, a portable electronic device includes an audio input device (including audio input circuitry) and a processor. The processor is configured to obtain audio input data including a noise signal having an audio feature, through the audio input device, to filter the audio input data using a neural network model to generate first audio output data, and to filter the first audio output data without using the neural network model to generate second audio output data. The first audio output data has a first changed audio feature corresponding to the audio feature and the second audio output data has a second changed audio feature corresponding to the audio feature.

In accordance with another aspect of the present disclosure, an electronic device includes a memory storing data corresponding to a neural network model and a processor electrically connected to the memory. The processor is configured to generate a first input signal including a voice signal and a first noise signal, to generate a second input signal including the voice signal and a second noise signal different from the first noise signal, to process the first input signal based at least partly on the neural network model to obtain an output signal, and to refine at least part of the neural network model based at least partly on a result of a comparison between the output signal and the second input signal.

In accordance with another aspect of the present disclosure, a storage medium stores an computer-readable instruction that, when executed by an electronic device, causes the electronic device to obtain audio input data including a noise signal having an audio feature, to filter the audio input data using a neural network model to generate first audio output data, and to filter the first audio output data without using the neural network model to generate second audio output data. The first audio output data has a first changed audio feature corresponding to the audio feature, and the second audio output data has a second changed audio feature corresponding to the audio feature.

According to various embodiments of the present disclosure, the noise removal efficiency may be constant regardless of a type of a noise. In addition, the noise removal efficiency may increase.

Besides, a variety of effects directly or indirectly understood through this disclosure may be provided.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
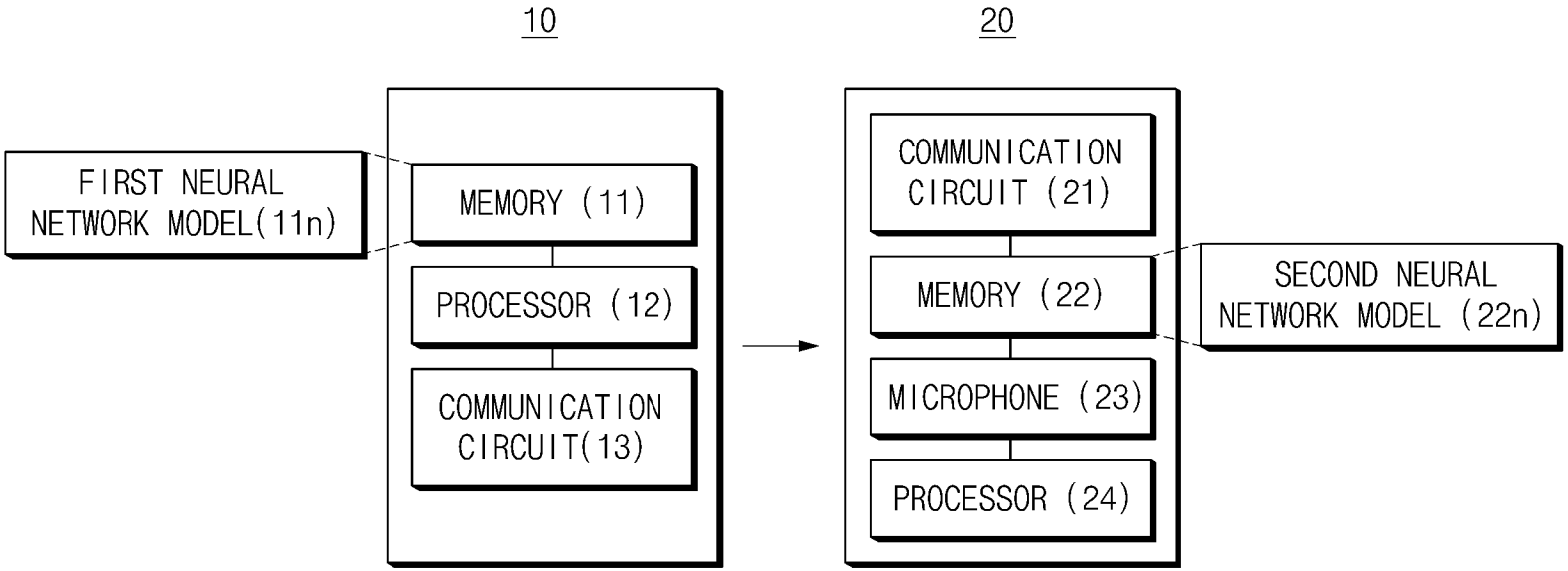
FIG. 1 is a block diagram illustrating an electronic device and a user terminal device, according to an embodiment.

Hereinafter, various example embodiments of the present disclosure may be described with reference to accompanying drawings. Accordingly, those of ordinary skill in the art will recognize that modifications, equivalents, and/or alternatives on the various embodiments described herein can be variously made without departing from the scope and spirit of the present disclosure. With regard to description of drawings, similar elements may be marked by similar reference numerals.

In this disclosure, the expressions "have", "may have", "include" and "comprise", or "may include" and "may comprise" used herein indicate existence of corresponding features (e.g., elements such as numeric values, functions, operations, or components) but do not exclude presence of additional features.

In this disclosure, the expressions "A or B", "at least one of A or/and B", or "one or more of A or/and B", and the like may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used in this disclosure may be used to refer to various elements regardless of the order and/or the priority and to distinguish the relevant elements from other elements, but do not limit the elements. For example, "a first user device" and "a second user device" indicate different user devices regardless of the order or priority. For example, without departing the scope of the present disclosure, a first element may be referred to as a second element, and similarly, a second element may be referred to as a first element.

It will be understood that when an element (e.g., a first element) is referred to as being "(operatively or communicatively) coupled with/to" or "connected to" another element (e.g., a second element), it may be directly coupled with/to or connected to the other element or an intervening element (e.g., a third element) may be present. On the other hand, when an element (e.g., a first element) is referred to as being "directly coupled with/to" or "directly connected to" another element (e.g., a second element), it should be understood that there are no intervening element (e.g., a third element).

According to the situation, the expression "configured to" used in this disclosure may be used interchangeably with, for example, the expression "suitable for", "having the capacity to", "designed to", "adapted to", "made to", or "capable of". The term "configured to" does not refer only "specifically designed to" in hardware. Instead, the expression "a device configured to" may refer to a situation in which the device is "capable of" operating together with another device or other components. For example, a "processor configured to (or set to) perform A, B, and C" may refer, for example, and without limitation, to a dedicated processor (e.g., an embedded processor) for performing a corresponding operation, a generic-purpose processor (e.g., a central processing unit (CPU) or an application processor) which performs corresponding operations by executing one or more software programs which are stored in a memory device, or the like.

Terms used in this disclosure are used to describe specified embodiments and are not intended to limit the scope of the present disclosure. The terms of a singular form may include plural forms unless otherwise specified. All the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal unless expressly so defined in various embodiments of this disclosure. In some cases, even if terms are terms which are defined in this disclosure, they may not be interpreted to exclude embodiments of this disclosure.

An electronic device according to various embodiments of this disclosure may include at least one of, for example, smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, mobile medical devices, cameras, or wearable devices, or the like, but is not limited thereto. According to various embodiments, the wearable device may include at least one of an accessory type (e.g., watches, rings, bracelets, anklets, necklaces, glasses, contact lens, or head-mounted-devices (HMDs), a fabric or garment-integrated type (e.g., an electronic apparel), a body-attached type (e.g., a skin pad or tattoos), or a bio-implantable type (e.g., an implantable circuit), or the like, but is not limited thereto.

According to various embodiments, the electronic device may be a home appliance. The home appliances may include at least one of, for example, televisions (TVs), digital versatile disc (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™, or Google TV™), game consoles (e.g., Xbox™ or Play Station™), electronic dictionaries, electronic keys, camcorders, electronic picture frames, or the like, but is not limited thereto.

According to another embodiment, an electronic device may include at least one of various medical devices (e.g., various portable medical measurement devices (e.g., a blood glucose monitoring device, a heartbeat measuring device, a blood pressure measuring device, a body temperature measuring device, and the like), a magnetic resonance angiography (MRA), a magnetic resonance imaging (MRI), a computed tomography (CT), scanners, and ultrasonic devices), navigation devices, Global Navigation Satellite System (GNSS), event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller's machines (ATMs), points of sales (POSs) of stores, or internet of things (e.g., light bulbs, various sensors, electric or gas meters, sprinkler devices, fire alarms, thermostats, street lamps, toasters, exercise equipment, hot water tanks, heaters, boilers, and the like), or the like, but is not limited thereto.

According to an embodiment, the electronic device may include at least one of parts of furniture or buildings/structures, electronic boards, electronic signature receiving devices, projectors, or various measuring instruments (e.g., water meters, electricity meters, gas meters, or wave meters, and the like), or the like, but is not limited thereto. According to various embodiments, the electronic device may be one of the above-described devices or a combination thereof. An electronic device according to an embodiment may be a flexible electronic device. Furthermore, an electronic device according to an embodiment of this disclosure may not be limited to the above-described electronic devices and may include other electronic devices and new electronic devices according to the development of technologies.

Hereinafter, electronic devices according to various embodiments will be described with reference to the accompanying drawings. In this disclosure, the term "user" may refer to a person who uses an electronic device or may refer to a device (e.g., an artificial intelligence electronic device) that uses the electronic device.

FIG. 1 is a block diagram illustrating an electronic device and a portable electronic device, according to an example embodiment.

Referring to FIG. 1, an electronic device 10 (e.g., an electronic device 902 or 904 or a server 906 in FIG. 9) may include a memory 11, a processor (e.g., including processing circuitry) 12, and a communication circuit 13. In the present disclosure, the electronic device 10 may, for example, and without limitation, be referred simply to as a "server" or "neural network model refine device", or the like.

The memory 11 may store a first neural network model 11*n*. The first neural network model 11*n* may be a learning algorithm that mathematically expresses the neuron structure of an animal nervous system.

The processor 12 may include various processing circuitry and refine the first neural network model 11*n* such that the first neural network model 11*n* outputs the desired value. In the present disclosure, the desired value may refer, for example, to a signal obtained by reducing (or removing) a noise signal from an audio signal input to, for example, a portable electronic device 20 (e.g., the electronic device 901). The audio signal may include a voice signal and a noise signal, as a signal associated with a sound input to the portable electronic device 20. The voice signal may refer, for example, to a signal associated with a user's voice input to the portable electronic device 20. The noise signal may refer, for example, to a signal that is generated at a periphery of the portable electronic device 20 and is input to the portable electronic device 20 together with the voice signal.

The communication circuit 13 may transmit the first neural network model 11*n* to the portable electronic device 20.

Figure 9:
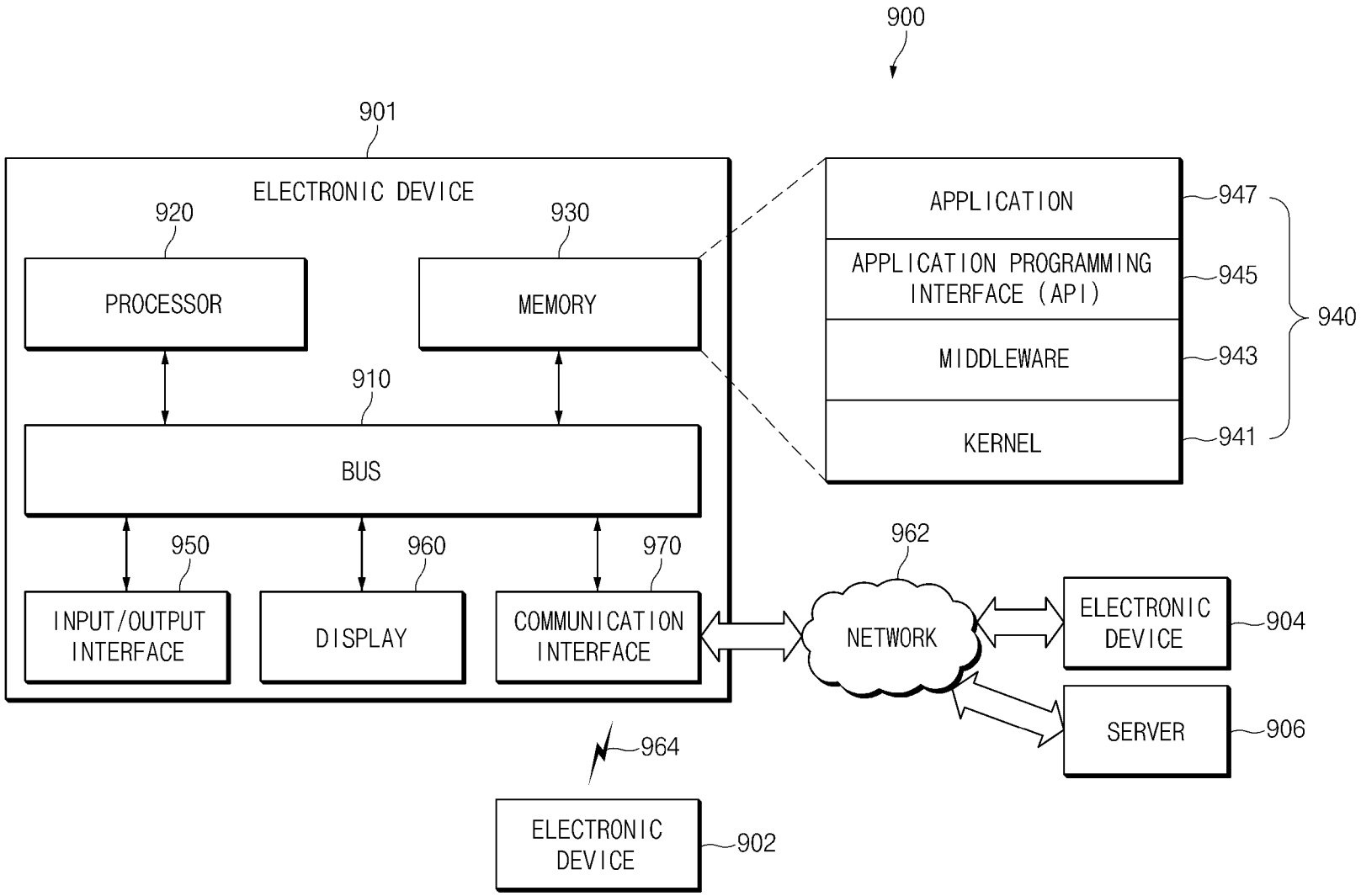
FIG. 9 is a diagram illustrating an electronic device in a network environment, according to various embodiments.

The portable electronic device 20 (e.g., the electronic device 901 in FIG. 9) may include a communication circuit 21 (e.g., a communication interface 970 in FIG. 9), a memory 22 (e.g., a memory 930 in FIG. 9), a microphone 23, and a processor (e.g., including processing circuitry) 24 (e.g., processor 920 in FIG. 9). In the present disclosure, the portable electronic device 20 may be referred to, for example, and without limitation, as a "smartphone", "speech recognition device", or "neural network model storage device", or the like.

The communication circuit 21 may receive the first neural network model 11*n* from the electronic device 10. The processor 24 may include various processing circuitry and refine a second neural network model 22*n* stored in the memory 22, using the received first neural network model 11*n*. For example, the second neural network model 22*n* may be a neural network model that has been stored in the portable electronic device 20. In addition, the second neural network model 22*n* may output a voice signal that is the same as, or similar to, the desired value as a neural network model refined or replaced using the first neural network model 11*n* received from the electronic device 10.

The memory 22 may store the second neural network model 22*n*. The memory 22 may store the first neural network model 11*n* received through the communication circuit 21 or may refine or replace the second neural network model 22*n* using the received first neural network model 11*n* to store the refined or replaced result.

The microphone 23 may receive an audio signal. The portable electronic device 20 may include the at least one microphone 23 and may receive an audio signal through the microphone 23. According to another embodiment, the portable electronic device 20 may include a plurality of microphones 23 and may receive the audio signal through each of the microphones 23.

The processor 24 may include various processing circuitry and/or program elements that reduce (or remove) a noise signal using the second neural network model 22*n*. For example, the processor 24 may provide the audio signal received through the microphone 23, to the second neural network model 22*n*. The second neural network model 22*n* may reduce (or remove) the noise signal from the audio signal. In the present disclosure, for example, the processor 24 may be referred to, for example, and without limitation, as an "application processor (AP)" or "communication processor (CP)", or the like.

In this disclosure, content described with reference to FIG. 1 may be identically applied to elements in other figures that have the same reference numerals as the elements described with reference to FIG. 1.

Figure 2:
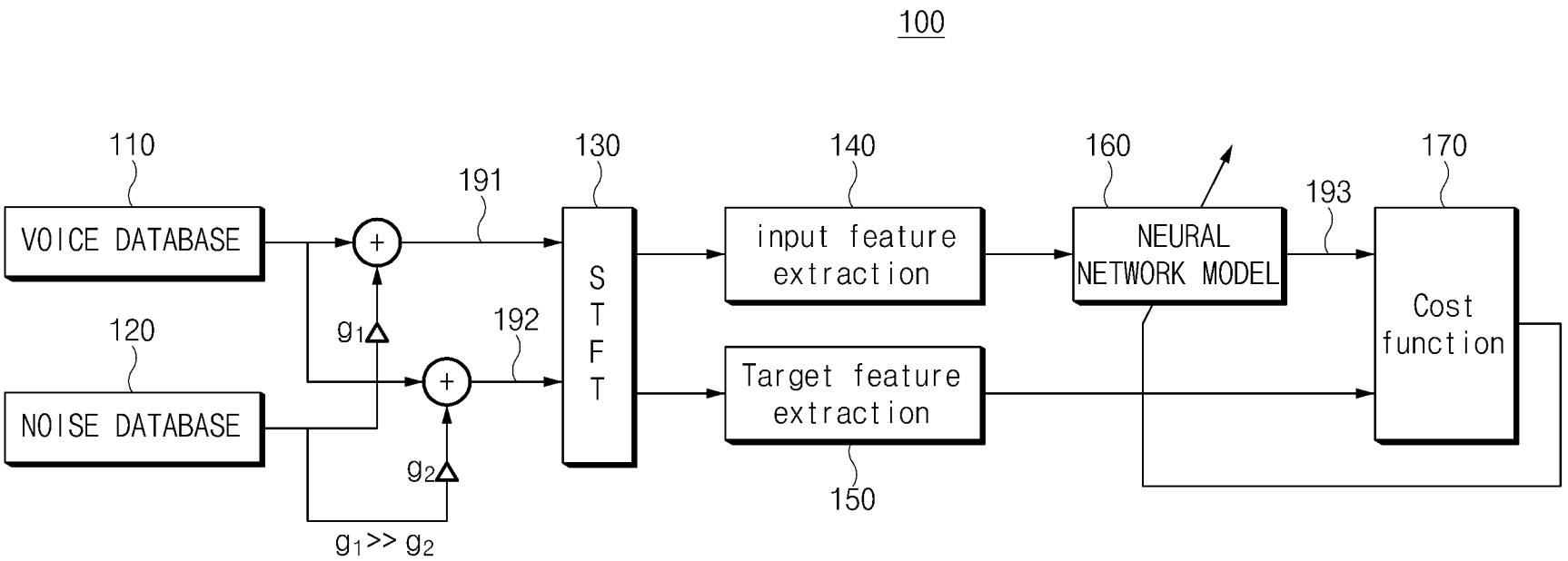
FIG. 2 is a block diagram illustrating an electronic device, according to an embodiment.

FIG. 2 is a block diagram illustrating an electronic device, according to an embodiment. In the case where a voice signal is input through one channel, an electronic device 100 (e.g., the electronic device 10) illustrated in FIG. 2 may be the electronic device 100 that refines a neural network model 160. In the present disclosure, the channel may refer, for example, to a path in which a voice signal is provided to the neural network model 160. Program modules 110, 120, 130, 140, 150, 160, and 170 illustrated in FIG. 2 may be stored in the memory 11 illustrated in FIG. 1, and may be executed by the processor 12.

Referring to FIG. 2, the processor 12 may include various processing circuitry and/or program elements that generate each of a voice signal and a noise signal. For the purpose of refining the neural network model 160 in an environment that is the same as, or similar to, an environment in which the portable electronic device 20 operates, the processor 12 may generate each of the voice signal and the noise signal using the voice database 110 and the noise database 120.

The processor 12 may amplify (or reduce) a noise signal to generate a first noise signal and a second noise signal. At this time, the magnitude of the second noise signal may be smaller than the magnitude of the first noise signal. For example, the processor 12 may generate the first noise signal and the second noise signal such that a difference between the magnitude of the first noise signal and the magnitude of the second noise signal is in a range of about 10 dB to about 20 dB.

If a noise signal is amplified (or reduced), the processor 12 may generate a first input signal and a second input signal. For example, the processor 12 may add the first noise signal to a voice signal to generate the first input signal. The first input signal may be a signal measured at a first point 191. In addition, the processor 12 may add the second noise signal to the voice signal to generate the second input signal.

The second input signal may be a signal measured at a second point 192, as a signal associated with the desired value to be obtained through the electronic device 100.

After finely dividing the first input signal and the second input signal using a window of a specific length, the short time fourier transform (STFT) module 130 may analyze each of the frequencies of the first input signal and the second input signal.

The input feature extraction module 140 may extract the feature value of the first input signal using the frequency analyzed by the STFT module 130. For example, input feature extraction module 140 may extract the normalized feature vector (e.g., normalized log-spectral magnitude, normalized Mel-frequency cepstral coefficient (MFCC), normalized linear prediction coefficient (LPC), or normalized linear prediction (LP) residual) of the first input signal. The feature value extracted by the input feature extraction module 140 may be transmitted to the neural network model 160.

The target feature value extraction module 150 may extract the feature value (or desired value) of the second input signal using the frequency analyzed by the STFT module 130.

The processor 12 may apply the feature value of the first input signal to the neural network model 160 to obtain the output value (or output signal). The output value may be a value measured at a third point 193, as the value output by the neural network model 160.

If the output value is obtained, the processor 12 may compare the output value with the desired value and may refine the neural network model 160 based on the comparison result. For example, if the output value is the same as (or similar to) the desired value, the processor 12 may refine the neural network model 160. The refined neural network model 160 may output the desired value as the output value to a voice signal (or newly input voice signal) input after the neural network model 160 is refined. According to an embodiment, the processor 12 may compare the output value with the desired value using the cost function block 170 and may refine the neural network model 160 based on the comparison result.

Figure 3:
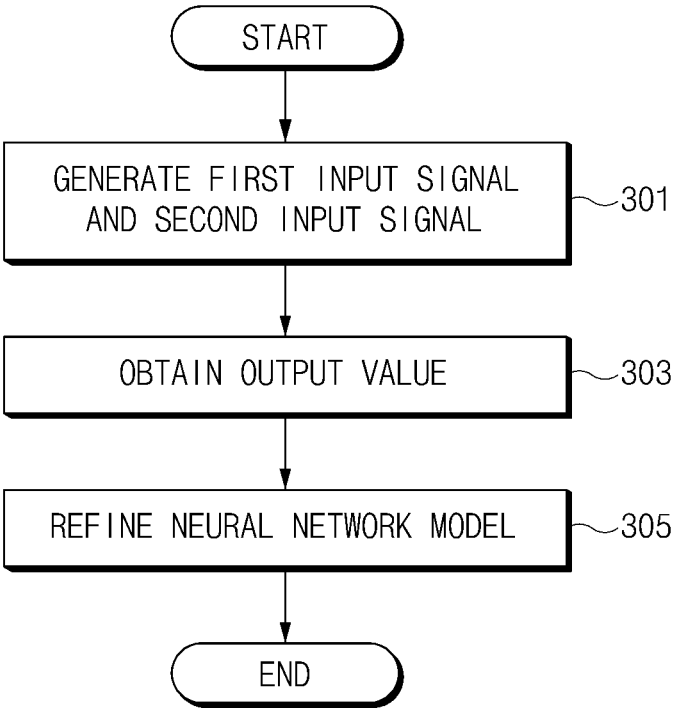
FIG. 3 is flowchart illustrating an operation of the electronic device according to an embodiment.

FIG. 3 is a flowchart illustrating an example operation of the electronic device according to an example embodiment. The flowchart illustrated in FIG. 3 may be applied to the electronic device 100 illustrated in FIG. 2.

Referring to FIG. 3, in operation 301, the electronic device 100 may generate a first input signal and a second input signal. For example, the electronic device 100 may add a first noise signal to a voice signal stored in the voice database 110 to generate the first input signal. In addition, the electronic device 100 may add a second noise signal to the voice signal to generate the second input signal.

According to an embodiment, as described in FIG. 2, the first noise signal and the second noise signal may be noise signals obtained by amplifying (or reducing) one noise signal. The first noise signal and the second noise signal may be noise signals different from each other. For example, the first noise signal may be noise at a periphery of the electronic device 100, and the second noise signal may be white noise. At this time, the magnitude of the second noise signal may be smaller than the magnitude of the first noise signal. For example, the processor 12 may generate the first noise signal and the second noise signal such that a difference between the magnitude of the first noise signal and the magnitude of the second noise signal is in a range of about 10 dB to about 20 dB.

According to an embodiment, the electronic device 100 may analyze the frequencies of the first input signal and the second input signal. After finely dividing the first input signal and the second input signal using a window of a specific length, the electronic device 100 may analyze each of the frequencies of the first input signal and the second input signal.

According to an embodiment, the electronic device 100 may extract each of the feature value of the first input signal and the feature value of the second input signal using the analyzed frequencies. For example, the electronic device 100 may obtain the normalized log-spectral magnitude of the first input signal and may obtain the normalized log-spectral magnitude of the second input signal.

In operation 303, the electronic device 100 may obtain an output value. For example, the electronic device 100 may provide the neural network model 160 with the feature value of the first input signal and may obtain the output value through the neural network model 160.

If the output value is obtained, in operation 305, the electronic device 100 may refine the neural network model 160. For example, the electronic device 100 may provide a cost function block with the output value and the feature value of the second input signal and may refine the neural network model 160 using stochastic gradient descent (SGD) or an optimization algorithm.

Figure 4:
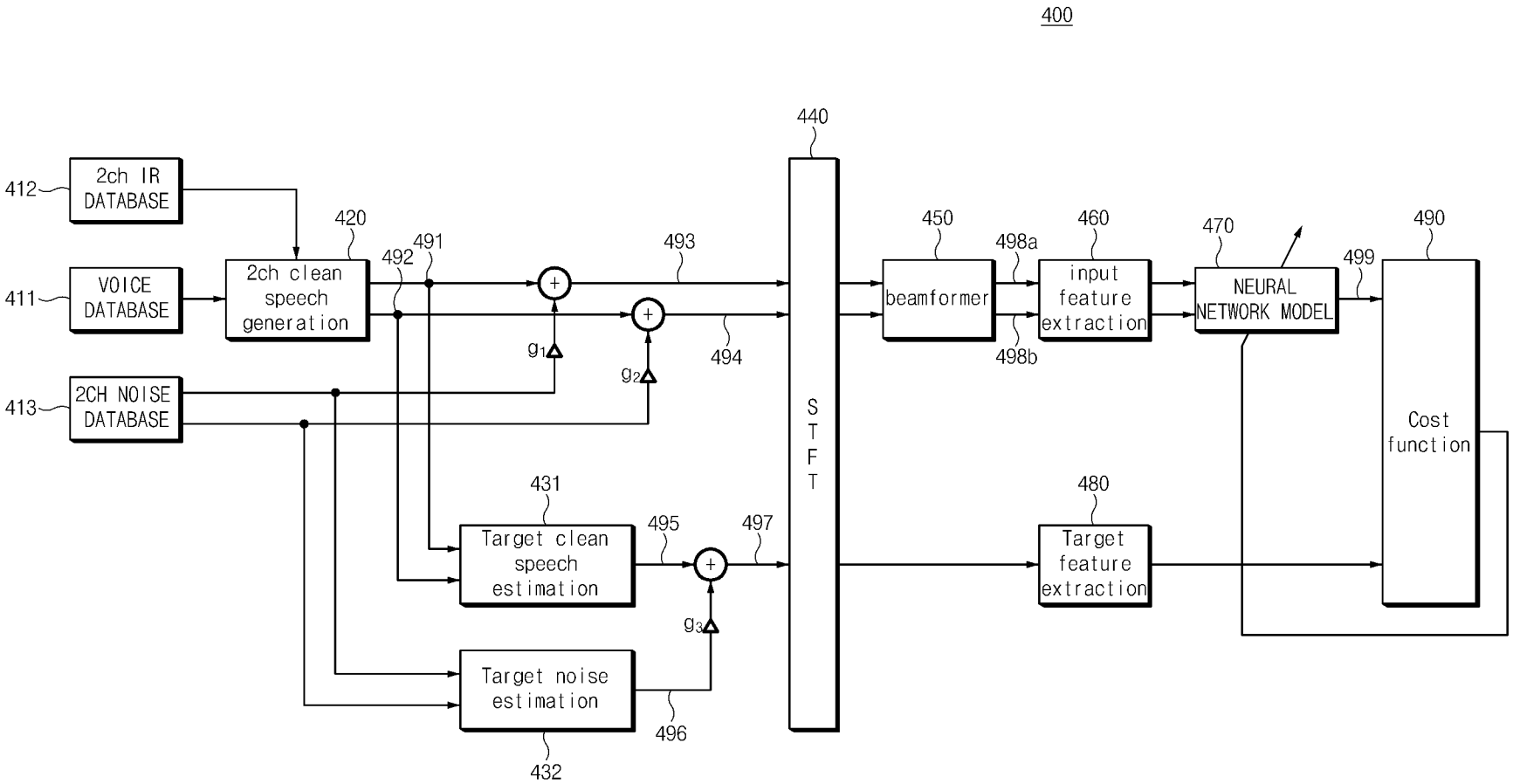
FIG. 4 is a block diagram illustrating an electronic device, according to another embodiment.

FIG. 4 is a block diagram illustrating an electronic device, according to another example embodiment. In the case where a voice signal is input through two channels, an electronic device 400 illustrated in FIG. 4 illustrates an electronic device refining a neural network model. Program modules 411, 412, 413, 420, 431, 432, 440, 450, 460, 470, 480, and 490 illustrated in FIG. 4 may be stored in the memory 11 illustrated in FIG. 1, and may be executed by the processor 12.

Referring to FIG. 4, the processor 12 may generate a 2ch voice signal and a 2ch noise signal using the voice database 411 and the noise database 413. Unless otherwise specified, the description about the voice signal and the noise signal illustrated in FIG. 2 may be applied to the voice signal and the noise signal, which will be described below.

The 2ch clean speech generation module 420 may generate a 2ch voice signal. For example, the 2ch clean speech generation module 420 may generate the first voice signal and the second voice signal as a 2-channel audio signal to which spatial characteristics of the impulse response (IR) are reflected, by performing a convolution operation on the voice signal stored in the voice database 411 and the IR stored in the 2ch IR database 412. At this time, in a general handset call environment, the magnitude of the second voice signal may be smaller than the magnitude of the first voice signal. The first voice signal may be a signal measured at a first point 491, and the second voice signal may be a signal measured at a second point 492.

The processor 12 may generate a first input signal and a second input signal using the first voice signal and the second voice signal. For example, the processor 12 may add the first noise signal to the first voice signal to generate the first input signal. The first input signal may be a signal measured at a third point 493. The processor 12 may add the second noise signal to the second voice signal to generate the second input signal. The second input signal may be a signal measured at a fourth point 494. In this case, the first noise signal may have a magnitude that is the same as or substantially similar to the second noise signal.

In the meantime, the target clean speech estimation module 431 may generate a third voice signal. For example, the target clean speech estimation module 431 may amplify (or reduce) the first voice signal and/or the second voice signal to generate the third voice signal. Furthermore, the target clean speech estimation module 431 may beamform the first voice signal and the second voice signal to generate the third voice signal. The third voice signal may be measured at a fifth point 495.

The target noise estimation module 432 may generate the third noise signal. For example, the target noise estimation module 432 may reduce the first noise signal and/or the second noise signal to generate the third noise signal. Moreover, the target noise estimation module 432 may beamform the first noise signal and the second noise signal to generate the third noise signal. The third noise signal is a signal measured at a sixth point 496, and the magnitude of the third noise signal may be smaller than the magnitude of the first noise signal or the second noise signal. For example, a difference between the magnitude of the third noise signal and the magnitude of the first noise signal or the magnitude of the second noise signal may be in a range of about 10 dB to about 20 dB.

If each of the third voice signal and the third noise signal is generated, the processor 12 may add the third noise signal to the third voice signal to generate the third input signal. The third input signal may be a signal measured at a seventh point 497, as a signal associated with the desired value to be obtained through the electronic device 400 (e.g., the electronic device 10).

The STFT module 440 may finely divide the first input signal, the second input signal, and the third input signal using a window of a specific length, and may analyze each of the frequencies of the first input signal, the second input signal, and the third input signal.

The beamformer 450 may beamform the first input signal and the second input signal to output the beamformed first input signal and the beamformed second input signal. The beamformed first input signal may be a signal measured at an eighth point 498*a*. The beamformed second input signal may be a signal measured at a ninth point 498*b*. According to an embodiment, the SNR of the beamformed first input signal may be very great, and the SNR of the beamformed second input signal may be very small. Since the SNR of the beamformed first input signal is very great, the magnitude of a voice signal included in the beamformed first input signal may be very great. In contrast, since the SNR of the beamformed second input signal is very small, the magnitude of a voice signal included in the beamformed second input signal may be very small. For example, a difference between the magnitude of the voice signal included in the beamformed first input signal and the magnitude of the voice signal included in the beamformed second input signal may not be less than about 30 dB.

The input feature extraction module 460 may extract each of the feature values of the beamformed first input signal and the beamformed second input signal. For example, the input feature extraction module 460 may extract the normalized feature vector (e.g., normalized log-spectral magnitude, normalized MFCC, normalized LPC, or normalized LP residual) of each of the beamformed first input signal and the beamformed second input signal. The feature values extracted by the input extraction module 460 may be transmitted to the neural network model 470.

The processor 12 may apply the feature value of the beamformed first input signal and the feature value of the beamformed second input signal to the neural network model 470 to obtain an output value. The output value may be a value measured at a tenth point 499, as a value output by the neural network model 470.

The target feature value extraction module 480 may extract the feature value (or desired value) of the third input signal using the frequency analyzed by the STFT module 440.

If each of the output value and the desired value is obtained, the processor 12 may compare the output value with the desired value and may refine the neural network model 470 based on the comparison result. The refined neural network model 470 may output the desired value as the output value to a voice signal (or newly input voice signal) input after the refined time. According to an embodiment, the processor 12 may compare the output value with the desired value using the cost function block 490 and may refine the neural network model 470 based on the comparison result.

According to an example embodiment of the present disclosure, an electronic device may include a memory storing data corresponding to a neural network model and a processor electrically connected to the memory. The processor may be configured to generate a first input signal including a voice signal and a first noise signal, to generate a second input signal including the voice signal and a second noise signal different from the first noise signal, to process the first input signal based at least partly on the neural network model to obtain an output signal, and to refine at least part of the neural network model based at least partly on a result of a comparison between the output signal and the second input signal.

According to an example embodiment of the present disclosure, the memory further may store a voice database and a noise database. The processor may be configured to generate the voice signal using the voice database and to generate the first noise signal and the second noise signal using the noise database.

According to an example embodiment of the present disclosure, the processor may be configured to extract a feature value of the first input signal and a feature value of the second input signal, to apply the feature value of the first input signal to the neural network model to obtain the output signal, and to refine the at least part of the neural network model based at least partly on a feature value of the output signal and the feature value of the second input signal.

According to an example embodiment of the present disclosure, the processor may be configured to perform the comparison using a cost function.

According to an example embodiment of the present disclosure, the processor may be configured to generate a third input signal including another voice signal, which is different from the voice signal, and the first noise signal and to apply the first input signal and the third input signal to the neural network model as at least part of the processing operation.

According to an example embodiment of the present disclosure, the processor may be configured to generate the voice signal and to reduce the generated voice signal to generate another voice signal.

According to an example embodiment of the present disclosure, the processor may be configured to extract the feature value of the first input signal and a feature value of the third input signal, to apply the feature value of the first input signal and the feature value of the third input signal to the neural network model to obtain the output signal, and to refine at least part of the neural network model based at least partly on a feature value of the output signal and the feature value of the second input signal.

According to an example embodiment of the present disclosure, the processor may be configured to beamform the first input signal and the third input signal to apply the beamformed first input signal and the beamformed third input signal to the neural network model.

According to an example embodiment of the present disclosure, the electronic device may further include a communication module comprising communication circuitry. The processor may be configured, if a specified condition is satisfied, to transmit the refined data to an external electronic device using the neural network model.

Figure 5:
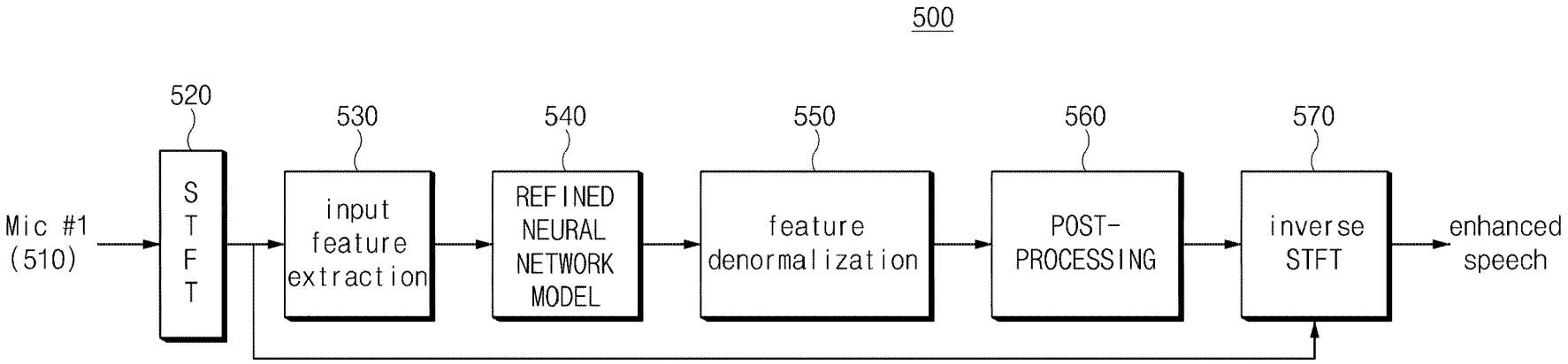
FIG. 5 is a block diagram illustrating a user terminal device, according to an embodiment.

FIG. 5 is a block diagram illustrating a portable electronic device, according to an example embodiment. A neural network model 540 illustrated in FIG. 5 may be a neural network model refined by the electronic device 100 illustrated in FIG. 2. Accordingly, a portable electronic device 500 (e.g., the portable electronic device 20 or the electronic device 901) illustrated in FIG. 5 may illustrate a portable electronic device that receives an audio signal through one channel and reduces (or removes) a noise signal from the received audio signal. In the meantime, program modules 520, 530, 540, 550, 560, and 570 illustrated in FIG. 5 may be stored in the memory 22 illustrated in FIG. 1, and may be executed by the processor 24.

Referring to FIG. 5, a microphone 510 (or an audio input device) may receive an audio signal (or an audio input data). Unless otherwise specified, the description about the microphone 23 in FIG. 1 may be applied to the microphone 510 illustrated in FIG. 5.

The STFT module 520 may finely divide an audio signal using a window of a specific length to analyze the frequency of the audio signal.

The input feature extraction module 530 may extract the feature value of the audio signal using the frequency analyzed by the STFT module 520. For example, the input feature extraction module 530 may extract the normalized feature vector (e.g., normalized log-spectral magnitude, normalized MFCC, normalized LPC, or normalized LP residual) of the audio signal. The feature value extracted by the input feature extraction module 530 may be transmitted to the refined neural network model 540.

The processor 24 may reduce (or remove) the feature value of a noise signal from the feature value of the audio signal using refined neural network model 540 to obtain the output value. The feature denormalization module 550 may denormalize the output value. For example, since the output value is the normalized value, the feature denormalization module 550 may denormalize the output value for speech synthesis.

The post-processing module 560 may reduce (or remove) the residual noise signal from the denormalized output value to obtain the first audio output signal (or the first audio output data). According to an embodiment, as described in FIG. 2, the electronic device 100 may train the neural network model 160 such that the residual noise signal (e.g., the second noise signal) is present. Accordingly, the residual noise signal may be present in the output value output through the refined neural network model. The post-processing module 560 may obtain the improved first audio output signal by reducing (or removing) the residual noise signal.

The inverse STFT module 570 may perform inverse-transformation on the first audio output signal to output a second audio output signal (e.g., a noise-free audio signal) (or second audio output data). For example, the inverse STFT module 570 may convert the first audio output signal on a frequency domain to the second audio output signal on a time domain. The second audio output signal may be output to the outside of the portable electronic device 500.

According to an embodiment, the inverse STFT module 570 may perform inverse-transformation on the first audio output signal using the phase of the audio signal.

According to an embodiment of the present disclosure, the portable electronic device 500 may transmit a call to an external electronic device (e.g., the electronic device 902 or 904 or the server 906 in FIG. 9). For example, the processor 24 may encode the second audio output signal to transmit the encoded second audio output signal to the external electronic device. Since the noise signal is reduced (or removed) in the second audio output signal, and the external electronic device may output a voice signal in which noise is reduced (or removed).

According to an embodiment of the present disclosure, the portable electronic device 500 may perform an operation corresponding to the voice signal. For example, the communication circuit 21 may transmit the second audio output signal to the external electronic device (e.g., the electronic device 902 or 904 or the server 906 in FIG. 9). The external electronic device may receive the second audio output signal to transmit a command corresponding to the second audio output signal to the portable electronic device 500 again. The portable electronic device 500 may perform an operation of the command. For example, if the command is a signal associated with the execution of an application, the portable electronic device 500 may execute the corresponding application.

According to an embodiment of the present disclosure, the portable electronic device 500 may refine a neural network model. For example, the communication circuit 21 may transmit the audio signal to the external electronic device (e.g., the electronic device 902 or 904 or the server 906 in FIG. 9). The external electronic device may transmit neural network model refinement data corresponding to the audio signal to the portable electronic device 500. The portable electronic device 500 may refine the neural network model based on the neural network model refinement data.

According to an embodiment of the present disclosure, the portable electronic device 500 may differently set a ratio for removing a noise signal, depending on a user environment. For example, the processor 24 may verify context information corresponding to the portable electronic device 500. If the context information is verified, the processor 24 may differently set the ratio for removing a noise signal from the audio signal, depending on the context information.

Figure 6:
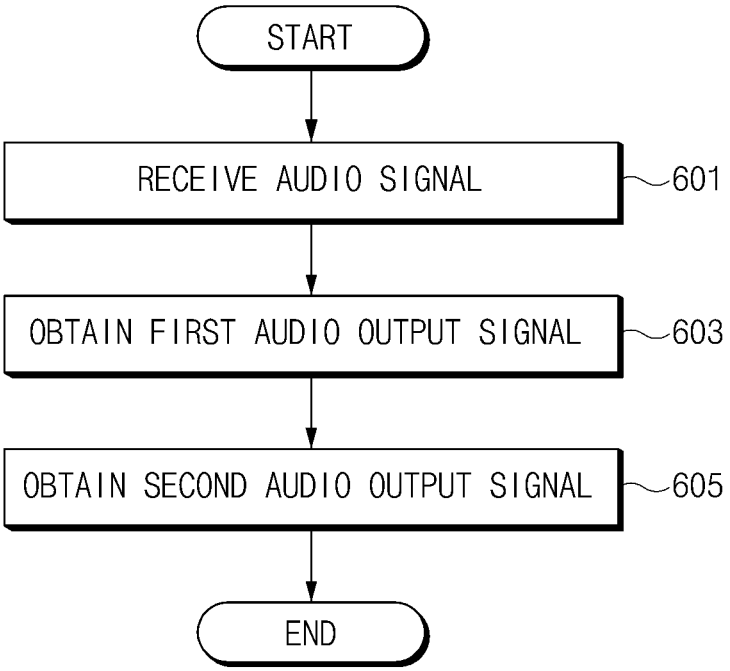
FIG. 6 is a flowchart illustrating an operation of a user terminal device, according to an embodiment.

FIG. 6 is a flowchart illustrating an example operation of a portable electronic device according to an example embodiment. The flowchart illustrated in FIG. 6 may be applied to an operation of the portable electronic device 500 illustrated in FIG. 5.

Referring to FIG. 6, in operation 601, the portable electronic device 500 may receive an audio signal through the microphone 510. At this time, the portable electronic device 500 may receive the audio signal through a plurality of microphones.

According to an embodiment, the portable electronic device 500 may analyze the frequency of the audio signal. The portable electronic device 500 may finely divide an audio signal using a window of a specific length to analyze the frequency of the audio signal.

According to an embodiment, the portable electronic device 500 may extract the normalized feature value of the audio signal, using the analyzed frequency. For example, the normalized feature value of the audio signal at least one or more of the normalized log-spectral magnitude, the normalized MFCC, the normalized LPC, or the normalized LP residual of the audio signal.

According to an embodiment, the portable electronic device 500 may obtain an output value through the neural network model 540. For example, the portable electronic device 500 may reduce (or remove) the feature value of a noise signal from the feature value of the audio signal to obtain the output value.

According to an embodiment, the portable electronic device 500 may denormalize the output value. For example, since the refined neural network model performs an arithmetic operation using the normalized value, the portable electronic device 500 may denormalize the output value.

In operation 603, the portable electronic device 500 may obtain a first audio output signal. For example, the portable electronic device 500 may remove a residual noise signal from the denormalized output value to obtain the first audio output signal. For example, the residual noise signal may correspond to the second noise signal described in FIG. 2. According to an embodiment, the residual noise signal may be included in the denormalized output value or may not be included therein. In the case where the residual noise signal is not included in the denormalized output value, an operation of removing the residual noise signal may be skipped.

In operation 605, the portable electronic device 500 may perform inverse-transformation on the first audio output signal to obtain the second audio output signal (e.g., a noise-free voice signal). The second audio output signal may be output to the outside of the portable electronic device 500 or may be transmitted to the external portable electronic device 500.

Figure 7:
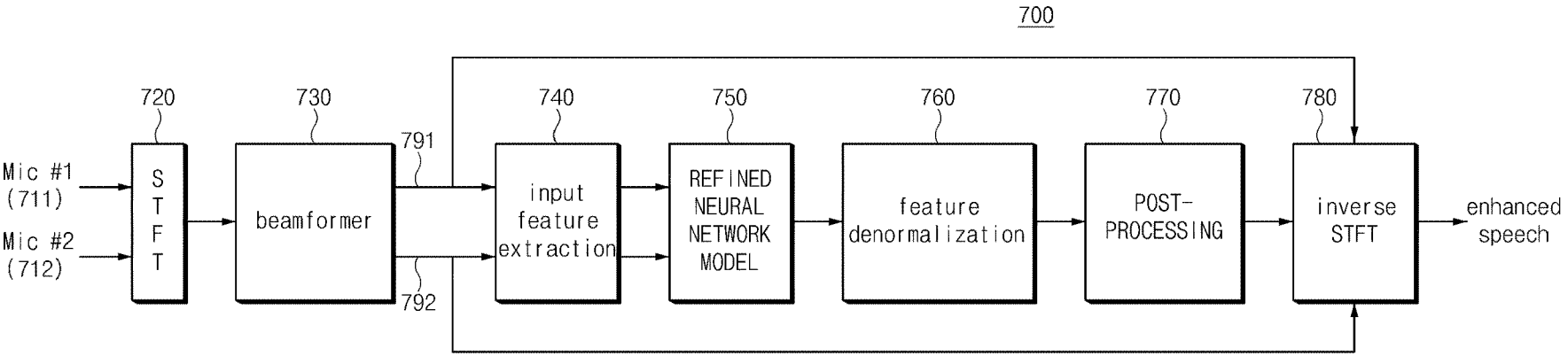
FIG. 7 is a block diagram illustrating a user terminal device, according to another embodiment.

FIG. 7 is a block diagram illustrating a portable electronic device, according to another example embodiment. A refined neural network model 750 illustrated in FIG. 7 may, for example, be a neural network model 470 refined by the electronic device 400 (e.g., the electronic device 10) illustrated in FIG. 4. Accordingly, a portable electronic device 700 (e.g., the portable electronic device 20) illustrated in FIG. 7 illustrates a portable electronic device 700 that receives an audio signal through two channels and reduces (or removes) a noise signal from the received audio signal. In the meantime, program modules 720, 730, 740, 750, 760, 770, and 780 illustrated in FIG. 7 may be stored in the memory 22 illustrated in FIG. 1, and may be executed by the processor 24.

Referring to FIG. 7, a first microphone 711 and a second microphone 712 may receive a first audio signal and a second audio signal, respectively. At this time, the first microphone 711 may be a microphone disposed in the portable electronic device 700 so as to be adjacent to a USB port. Accordingly, in the case where a user makes a call through the portable electronic device 700, the first microphone 711 may be placed at a location adjacent to the user's mouth. Since the first audio signal is an audio signal received through the first microphone 711, the magnitude of the voice signal may be greater than the magnitude of the noise signal (or the SNR of the voice signal may be greater than the SNR of the noise signal).

The second microphone 712 may be a microphone disposed adjacent to a proximity sensor in the portable electronic device 700. Accordingly, in the case where a user makes a call through the portable electronic device 700, the second microphone 712 may be placed at a location adjacent to the user's ears. Since the second audio signal is an audio signal received through the second microphone 712, the magnitude of the voice signal may be smaller than the magnitude of the noise signal (or the SNR of the voice signal may be smaller than the SNR of the noise signal).

The STFT module 720 may finely divide the first audio signal and the second audio signal using a window of a specific length to analyze the frequencies of the first audio signal and the second audio signal.

The beamformer 730 may beamform the first audio signal and the second audio signal to generate the first input signal and the second input signal. The first input signal and the second input signal may be signals measured at a first point 791 and a second point 792, respectively. In the meantime, according to an embodiment of the present disclosure, the processor 24 may provide the input feature extraction module 740 with the first audio signal and the second audio signal without beamforming.

The input feature extraction module 740 may extract the feature values of the first input signal and the second input signal. For example, the input feature extraction module 740 may extract the feature vector (e.g., log-spectral magnitude, normalized MFCC, normalized LPC, or normalized LP residual) of each of the first input signal and the second input signal. The feature values extracted by the input feature extraction module 740 may be transmitted to the refined neural network model 750.

The processor 24 may obtain output values corresponding to the feature value of the first input signal and the feature value of the second input signal, using the refined neural network model 750. For example, the refined neural network model 750 may reduce (or remove) the feature value of a noise signal from the feature value of the first input signal and/or the feature value of the second input signal to obtain an output value.

The feature denormalization module 760 may denormalize the output value. For example, since the output value is the normalized value, the feature denormalization module 760 may denormalize the output value for speech synthesis.

The post-processing module 770 may reduce (or remove) the residual noise signal from the denormalized output value to obtain the first audio output signal. According to an embodiment, as described in FIG. 4, the electronic device 400 may train the neural network model 470 such that the residual noise signal (e.g., the third noise signal) is present. Accordingly, the residual noise signal may be present in the output value output through the refined neural network model. The post-processing module 770 may obtain the improved first audio output signal by reducing (or removing) the residual noise signal.

The inverse STFT module 780 may perform inverse-transformation on the first audio output signal to output a second audio output signal (e.g., a noise-free audio signal). For example, the inverse STFT module 780 may convert the first audio output signal on a frequency domain to the second audio output signal on a time domain. The second audio output signal may be output to the outside of the portable electronic device 700. According to an embodiment, the inverse STFT module 780 may perform inverse-transformation on the first audio output signal, using the phase of the first input signal and/or the second input signal generated by the beamformer 730.

According to an example embodiment of the present disclosure, a portable electronic device may include an audio input device (including audio input circuitry) and a processor. The processor may be configured to obtain audio input data including a noise signal having an audio feature through the audio input device, to filter the audio input data using a neural network model to generate first audio output data, and to filter the first audio output data without using the neural network model to generate second audio output data. The first audio output data may have a first changed audio feature corresponding to the audio feature and the second audio output data may have a second changed audio feature corresponding to the audio feature.

According to an example embodiment of the present disclosure, the processor may be configured to process a part, which corresponds to the noise signal, of the audio input data to generate the first audio output data.

According to an example embodiment of the present disclosure, the processor may be configured to perform the filtering of the audio input data such that a difference between a first signal-to-noise ratio (SNR) of the audio input data and a second SNR of the first audio output data belongs to a specified range and to perform the filtering of the first audio output data such that a difference between the second SNR and a third SNR of the second audio output data belongs to another specified range.

According to an example embodiment of the present disclosure, the portable electronic device may further include a communication module comprising communication circuitry. The processor may be configured to transmit at least part of the audio input data to an external electronic device through the communication module, to receive filter model data associated with the neural network model corresponding to the at least part of the audio input data, from the external electronic device, and to perform the filtering of the audio input data using the received filter model data.

According to an example embodiment of the present disclosure, the portable electronic device may further include a memory storing first filter model data and second filter model data, which are associated with the neural network model. The processor may be configured to verify context information corresponding to the portable electronic device, to select the first filter model data or the second filter model data based at least on the context information, and to perform the filtering of the audio input data using the selected filter model data.

According to an example embodiment of the present disclosure, the audio input device may include a first audio input device (including audio input circuitry) and a second audio input device (including audio input circuitry). The audio input data may include first audio input data and second audio input data. The processor may be configured to obtain the first audio input data through the first audio input device and the second audio input data through the second audio input device, as at least part of the operation of obtaining the audio input data and to perform pre-processing on the first audio input data and the second audio input data using beamforming.

According to an example embodiment of the present disclosure, the processor may be configured to perform the filtering of the first audio output data using at least part of the audio input data.

According to an example embodiment of the present disclosure, the processor may be configured to encode the second audio output data to transmit the encoded second audio output data to an external electronic device.

According to an example embodiment of the present disclosure, the processor may be configured to transmit the second audio output data to an external electronic device, to receive a command corresponding to the second audio output data from the external electronic device, and to perform a function corresponding to the command.

Figure 8:
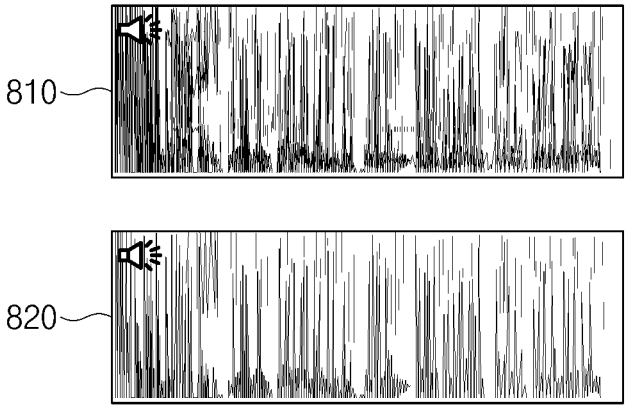
FIG. 8 is a diagram illustrating an audio signal, a noise signal, and a voice signal, according to an embodiment.

FIG. 8 is a diagram illustrating an audio signal, a noise signal, and a voice signal, according to an example embodiment.

Referring to FIG. 8, a graph 810 and a graph 820 illustrate examples of an audio signal 810, and a voice signal 820 in which a noise signal is removed, respectively. The portable electronic device 20 may receive the audio signal 810 through a microphone. The received audio signal 810 may be provided to the refined neural network model, and the portable electronic device 20 may remove a noise signal through the refined neural network model. If the noise signal is removed, the voice signal 820 in which the noise signal is removed may be obtained.

FIG. 9 is a diagram illustrating an electronic device in a network environment, according to various example embodiments.

Referring to FIG. 9, according to various embodiments, an electronic device 901, a first electronic device 902, a second electronic device 904, and/or a server 906 may be connected each other over a network 962 or a short range communication channel 964. The electronic device 901 may include a bus 910, a processor (e.g., including processing circuitry) 920, a memory 930, an input/output interface (e.g., including input/output circuitry) 950, a display 960, and a communication interface (e.g., including communication circuitry) 970. According to an embodiment, the electronic device 901 may not include at least one of the above-described elements or may further include other element(s).

For example, the bus 910 may interconnect the above-described elements 910 to 970 and may include a circuit for conveying communications (e.g., a control message and/or data) among the above-described elements.

The processor 920 may include various processing circuitry, such as, for example, and without limitation, one or more of a dedicated processor, a central processing unit (CPU), an application processor (AP), or a communication processor (CP), or the like. For example, the processor 920 may perform an arithmetic operation or data processing associated with control and/or communication of at least other elements of the electronic device 901.

The memory 930 may include a volatile and/or nonvolatile memory. For example, the memory 930 may store instructions or data associated with at least one other element(s) of the electronic device 901. According to an embodiment, the memory 930 may store software and/or a program 940. The program 940 may include, for example, a kernel 941, a middleware 943, an application programming interface (API) 945, and/or an application program (or "an application") 947. At least a part of the kernel 941, the middleware 943, or the API 945 may be referred to as an "operating system (OS)".

For example, the kernel 941 may control or manage system resources (e.g., the bus 910, the processor 920, the memory 930, and the like) that are used to execute operations or functions of other programs (e.g., the middleware 943, the API 945, and the application program 947). Furthermore, the kernel 941 may provide an interface that allows the middleware 943, the API 945, or the application program 947 to access discrete elements of the electronic device 901 so as to control or manage system resources.

The middleware 943 may perform, for example, a mediation role such that the API 945 or the application program 947 communicates with the kernel 941 to exchange data.

Furthermore, the middleware 943 may process task requests received from the application program 947 according to a priority. For example, the middleware 943 may assign the priority, which makes it possible to use a system resource (e.g., the bus 910, the processor 920, the memory 930, or the like) of the electronic device 901, to at least one of the application program 947. For example, the middleware 943 may process the one or more task requests according to the priority assigned to the at least one, which makes it possible to perform scheduling or load balancing on the one or more task requests.

The API 945 may be, for example, an interface through which the application program 947 controls a function provided by the kernel 941 or the middleware 943, and may include, for example, at least one interface or function (e.g., an instruction) for a file control, a window control, image processing, a character control, or the like.

The input/output interface 950 may include various input/output circuitry and play a role, for example, of an interface which transmits an instruction or data input from a user or another external device, to other element(s) of the electronic device 901. Furthermore, the input/output interface 950 may output an instruction or data, received from other element(s) of the electronic device 901, to a user or another external device.

The display 960 may include, for example, a liquid crystal display (LCD), a light-emitting diode (LED) display, an organic LED (OLED) display, a microelectromechanical systems (MEMS) display, or an electronic paper display, or the like, but is not limited thereto. The display 960 may display, for example, various contents (e.g., a text, an image, a video, an icon, a symbol, and the like) to a user. The display 960 may include a touch screen and may receive, for example, a touch, gesture, proximity, or hovering input using an electronic pen or a part of a user's body.

For example, the communication interface 970 may include various communication circuitry and establish communication between the electronic device 901 and an external device (e.g., the first electronic device 902, the second electronic device 904, or the server 906). For example, the communication interface 970 may be connected to the network 962 over wireless communication or wired communication to communicate with the external device (e.g., the second electronic device 904 or the server 906).

The wireless communication may use at least one of, for example, long-term evolution (LTE), LTE Advanced (LTE-A), Code Division Multiple Access (CDMA), Wideband CDMA (WCDMA), Universal Mobile Telecommunications System (UMTS), Wireless Broadband (WiBro), Global System for Mobile Communications (GSM), or the like, as cellular communication protocol. Furthermore, the wireless communication may include, for example, the short range communication 964. The short range communication 964 may include at least one of wireless fidelity (Wi-Fi), light fidelity (LiFi) Bluetooth, near field communication (NFC), magnetic stripe transmission (MST), a global navigation satellite system (GNSS), or the like.

The MST may generate a pulse in response to transmission data using an electromagnetic signal, and the pulse may generate a magnetic field signal. The electronic device 901 may transfer the magnetic field signal to point of sale (POS), and the POS may detect the magnetic field signal using a MST reader. The POS may recover the data by converting the detected magnetic field signal to an electrical signal.

The GNSS may include at least one of, for example, a global positioning system (GPS), a global navigation satellite system (Glonass), a Beidou navigation satellite system (hereinafter referred to as "Beidou"), or an European global satellite-based navigation system (hereinafter referred to as "Galileo") based on an available region, a bandwidth, or the like. Hereinafter, in this disclosure, "GPS" and "GNSS" may be interchangeably used. The wired communication may include at least one of, for example, a universal serial bus (USB), a high definition multimedia interface (HDMI), a recommended standard-232 (RS-232), a plain old telephone service (POTS), or the like. The network 962 may include at least one of telecommunications networks, for example, a computer network (e.g., LAN or WAN), an Internet, or a telephone network.

Each of the first and second electronic devices 902 and 904 may be a device of which the type is different from or the same as that of the electronic device 901. According to an embodiment, the server 906 may include a group of one or more servers. According to various embodiments, all or a portion of operations that the electronic device 901 will perform may be executed by another or plural electronic devices (e.g., the first electronic device 902, the second electronic device 904 or the server 906). According to an embodiment, in the case where the electronic device 901 executes any function or service automatically or in response to a request, the electronic device 901 may not perform the function or the service internally, but, alternatively additionally, it may request at least a portion of a function associated with the electronic device 901 from another device (e.g., the electronic device 902 or 904 or the server 906). The other electronic device may execute the requested function or additional function and may transmit the execution result to the electronic device 901. The electronic device 901 may provide the requested function or service using the received result or may additionally process the received result to provide the requested function or service. To this end, for example, cloud computing, distributed computing, or client-server computing may be used.

Figure 10:
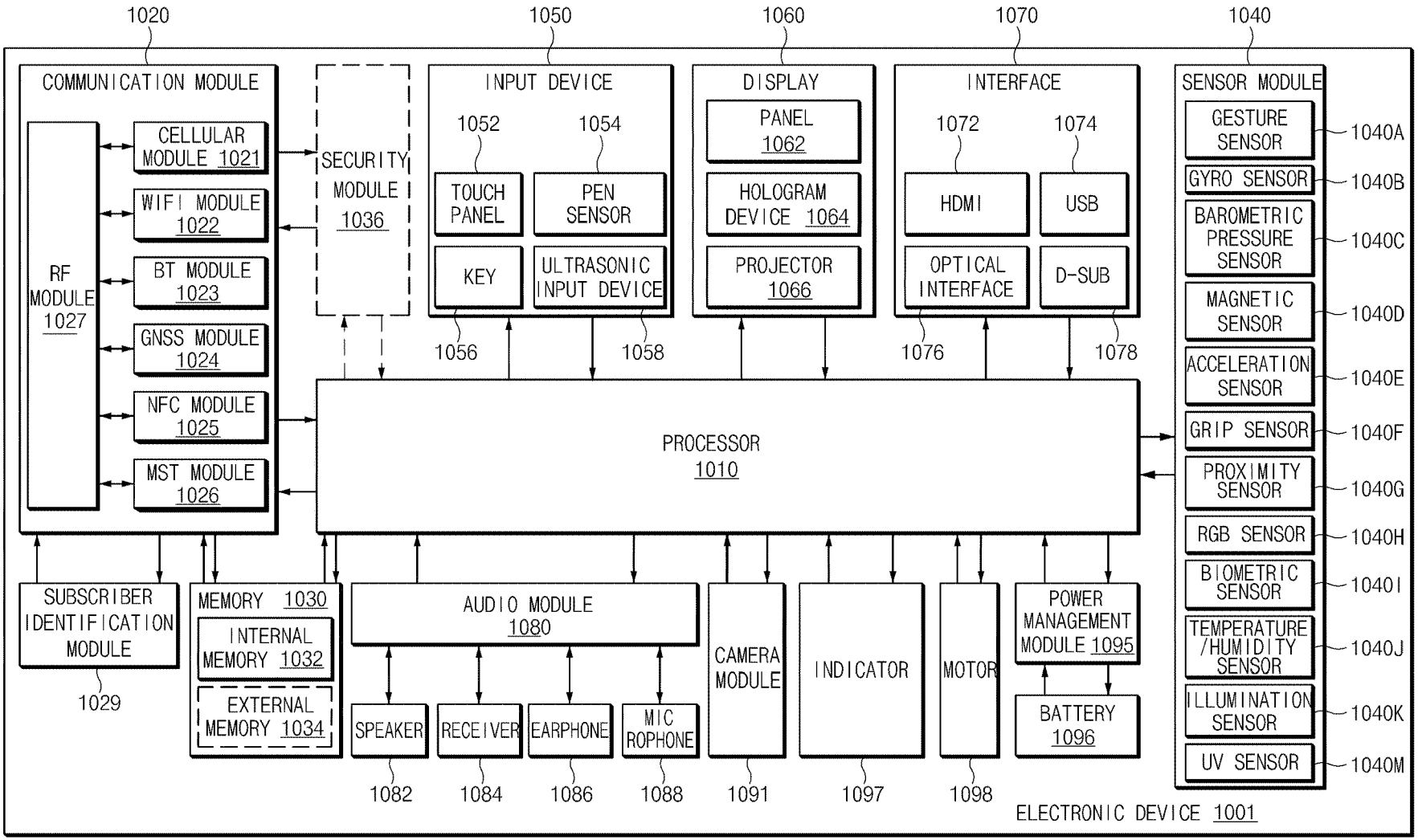
FIG. 10 is a block diagram illustrating the electronic device, according to various embodiments.

FIG. 10 is a block diagram illustrating an electronic device, according to various example embodiments.

Referring to FIG. 10, an electronic device 1001 may include, for example, all or a part of the electronic device 901 illustrated in FIG. 9. The electronic device 1001 may include one or more processors (e.g., an application processor (AP)) (e.g., including processing circuitry) 1010, a communication module (e.g., including communication circuitry) 1020, a subscriber identification module 1029, a memory 1030, a security module 1036, a sensor module 1040, an input device (e.g., including input circuitry) 1050, a display 1060, an interface (e.g., including interface circuitry) 1070, an audio module 1080, a camera module 1091, a power management module 1095, a battery 1096, an indicator 1097, and a motor 1098.

The processor 1010 may include various processing circuitry and drive, for example, an operating system (OS) or an application to control a plurality of hardware or software elements connected to the processor 1010 and may process and compute a variety of data. For example, the processor 1010 may be implemented with a System on Chip (SoC). According to an embodiment, the processor 1010 may further include a graphic processing unit (GPU) and/or an image signal processor. The processor 1010 may include at least a part (e.g., a cellular module 1021) of elements illustrated in FIG. 10. The processor 1010 may load a command or data, which is received from at least one of other elements (e.g., a nonvolatile memory), into a volatile memory and process the loaded command or data. The processor 1010 may store a variety of data in the nonvolatile memory.

The communication module 1020 may be configured the same as or similar to the communication interface 970 of FIG. 9. The communication module 1020 may include various communication chips including various communication circuitry, such as, for example, and without limitation, the cellular module 1021, a Wi-Fi module 1022, a Bluetooth (BT) module 1023, a GNSS module 1024 (e.g., a GPS module, a Glonass module, a Beidou module, or a Galileo module), a near field communication (NFC) module 1025, a MST module 1026 and a radio frequency (RF) module 1027, or the like.

The cellular module 1021 may provide, for example, voice communication, video communication, a character service, an Internet service, or the like over a communication network. According to an embodiment, the cellular module 1021 may perform discrimination and authentication of the electronic device 1001 within a communication network using the subscriber identification module (e.g., a SIM card) 1029. According to an embodiment, the cellular module 1021 may perform at least a portion of functions that the processor 1010 provides. According to an embodiment, the cellular module 1021 may include a communication processor (CP).

Each of the Wi-Fi module 1022, the BT module 1023, the GNSS module 1024, the NFC module 1025, or the MST module 1026 may include a processor for processing data exchanged through a corresponding module, for example. According to an embodiment, at least a part (e.g., two or more) of the cellular module 1021, the Wi-Fi module 1022, the BT module 1023, the GNSS module 1024, the NFC module 1025, or the MST module 1026 may be included within one Integrated Circuit (IC) or an IC package.

For example, the RF module 1027 may transmit and receive a communication signal (e.g., an RF signal). For example, the RF module 1027 may include a transceiver, a power amplifier module (PAM), a frequency filter, a low noise amplifier (LNA), an antenna, or the like. According to another embodiment, at least one of the cellular module 1021, the Wi-Fi module 1022, the BT module 1023, the GNSS module 1024, the NFC module 1025, or the MST module 1026 may transmit and receive an RF signal through a separate RF module.

The subscriber identification module 1029 may include, for example, a card and/or embedded SIM that includes a subscriber identification module and may include unique identity information (e.g., integrated circuit card identifier (ICCID)) or subscriber information (e.g., integrated mobile subscriber identity (IMSI)).

The memory 1030 (e.g., the memory 930) may include an internal memory 1032 and/or an external memory 1034. For example, the internal memory 1032 may include at least one of a volatile memory (e.g., a dynamic random access memory (DRAM), a static RAM (SRAM), a synchronous DRAM (SDRAM), or the like), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory or a NOR flash memory), or the like), a hard drive, or a solid state drive (SSD).

The external memory 1034 may further include a flash drive such as compact flash (CF), secure digital (SD), micro secure digital (Micro-SD), mini secure digital (Mini-SD), extreme digital (xD), a multimedia card (MMC), a memory stick, or the like. The external memory 1034 may be operatively and/or physically connected to the electronic device 1001 through various interfaces.

A security module 1036 may be a module that includes a storage space of which a security level is higher than that of the memory 1030 and may be a circuit that guarantees safe data storage and a protected execution environment. The security module 1036 may be implemented with a separate circuit and may include a separate processor. For example, the security module 1036 may be in a smart chip or a secure digital (SD) card, which is removable, or may include an embedded secure element (eSE) embedded in a fixed chip of the electronic device 1001. Furthermore, the security module 1036 may operate based on an operating system (OS) that is different from the OS of the electronic device 1001. For example, the security module 1036 may operate based on java card open platform (JCOP) OS.

The sensor module 1040 may measure, for example, a physical quantity or may detect an operation state of the electronic device 1001. The sensor module 1040 may convert the measured or detected information to an electrical signal. For example, the sensor module 1040 may include at least one of a gesture sensor 1040A, a gyro sensor 1040B, a barometric pressure sensor 1040C, a magnetic sensor 1040D, an acceleration sensor 1040E, a grip sensor 1040F, the proximity sensor 1040G, a color sensor 1040H (e.g., red, green, blue (RGB) sensor), a biometric sensor 1040I, a temperature/humidity sensor 1040J, an illumination sensor 1040K, and/or an UV sensor 1040M. Although not illustrated, additionally or generally, the sensor module 1040 may further include, for example, an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 1040 may further include a control circuit for controlling at least one or more sensors included therein. According to an embodiment, the electronic device 1001 may further include a processor that is a part of the processor 1010 or independent of the processor 1010 and is configured to control the sensor module 1040. The processor may control the sensor module 1040 while the processor 1010 remains at a sleep state.

The input device 1050 may include various input circuitry, such as, for example, and without limitation, a touch panel 1052, a (digital) pen sensor 1054, a key 1056, and/or an ultrasonic input unit 1058, or the like. For example, the touch panel 1052 may use at least one of capacitive, resistive, infrared and ultrasonic detecting methods. Also, the touch panel 1052 may further include a control circuit. The touch panel 1052 may further include a tactile layer to provide a tactile reaction to a user.

The (digital) pen sensor 1054 may be, for example, a part of a touch panel or may include an additional sheet for recognition. The key 1056 may include, for example, a physical button, an optical key, a keypad, or the like. The ultrasonic input device 1058 may detect (or sense) an ultrasonic signal, which is generated from an input device, through a microphone (e.g., a microphone 1088) and may check data corresponding to the detected ultrasonic signal.

The display 1060 (e.g., the display 960) may include a panel 1062, a hologram device 1064, or a projector 1066. The panel 1062 may be the same as or similar to the display 960 illustrated in FIG. 9. The panel 1062 may be implemented, for example, to be flexible, transparent or wearable. The panel 1062 and the touch panel 1052 may be integrated into a single module. The hologram device 1064 may display a stereoscopic image in a space using a light interference phenomenon. The projector 1066 may project light onto a screen so as to display an image. For example, the screen may be arranged in the inside or the outside of the electronic device 1001. According to an embodiment, the display 1060 may further include a control circuit for controlling the panel 1062, the hologram device 1064, or the projector 1066.

The interface 1070 may include various interface circuitry, such as, for example, and without limitation, a high-definition multimedia interface (HDMI) 1072, a universal serial bus (USB) 1074, an optical interface 1076, and/or a D-subminiature (D-sub) 1078, or the like. The interface 1070 may be included, for example, in the communication interface 970 illustrated in FIG. 9. Additionally or generally, the interface 1070 may include, for example, a mobile high definition link (MHL) interface, a SD card/multi-media card (MMC) interface, or an infrared data association (IrDA) standard interface.

The audio module 1080 may convert a sound and an electric signal in dual directions. At least a part of the audio module 1080 may be included, for example, in the input/output interface 950 illustrated in FIG. 9. The audio module 1080 may process, for example, sound information that is input or output through a speaker 1082, a receiver 1084, an earphone 1086, or the microphone 1088.

For example, the camera module 1091 may shoot a still image or a video. According to an embodiment, the camera module 1091 may include at least one or more image sensors (e.g., a front sensor or a rear sensor), a lens, an image signal processor (ISP), or a flash (e.g., an LED or a xenon lamp).

The power management module 1095 may manage, for example, power of the electronic device 1001. According to an embodiment, a power management integrated circuit (PMIC), a charger IC, or a battery or fuel gauge may be included in the power management module 1095. The PMIC may have a wired charging method and/or a wireless charging method. The wireless charging method may include, for example, a magnetic resonance method, a magnetic induction method or an electromagnetic method and may further include an additional circuit, for example, a coil loop, a resonant circuit, or a rectifier, and the like. The battery gauge may measure, for example, a remaining capacity of the battery 1096 and a voltage, current or temperature thereof while the battery is charged. The battery 1096 may include, for example, a rechargeable battery and/or a solar battery.

The indicator 1097 may display a specific state of the electronic device 1001 or a part thereof (e.g., the processor 1010), such as a booting state, a message state, a charging state, and the like. The motor 1098 may convert an electrical signal into a mechanical vibration and may generate the following effects: vibration, haptic, and the like. Although not illustrated, a processing device (e.g., a GPU) for supporting a mobile TV may be included in the electronic device 1001. The processing device for supporting the mobile TV may process media data according to the standards of digital multimedia broadcasting (DMB), digital video broadcasting (DVB), MediaFlo™, or the like.

Each of the above-mentioned elements of the electronic device according to various embodiments of the present disclosure may be configured with one or more components, and the names of the elements may be changed according to the type of the electronic device. In various embodiments, the electronic device may include at least one of the above-mentioned elements, and some elements may be omitted or other additional elements may be added. Furthermore, some of the elements of the electronic device according to various embodiments may be combined with each other so as to form one entity, so that the functions of the elements may be performed in the same manner as before the combination.

Figure 11:
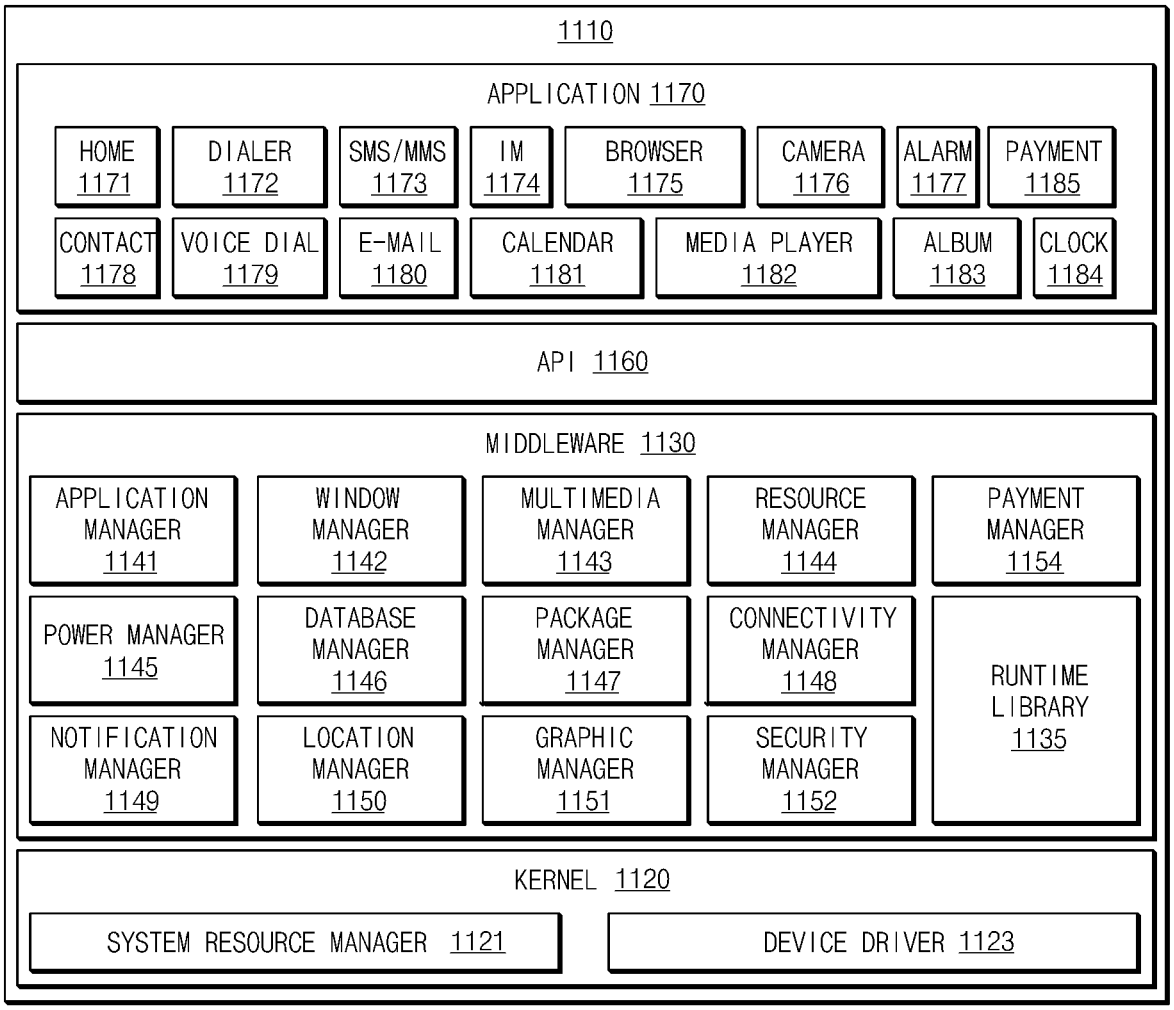
FIG. 11 is a block diagram illustrating a program module, according to various embodiments.

FIG. 11 is a block diagram illustrating a program module, according to various example embodiments.

According to an embodiment, a program module 1110 (e.g., the program 940) may include an operating system (OS) to control resources associated with an electronic device (e.g., the electronic device 901), and/or diverse applications (e.g., the application program 947) driven on the OS. The OS may be, for example, Android, iOS, Windows, Symbian, or Tizen.

The program module 1110 may include a kernel 1120, a middleware 1130, an application programming interface (API) 1160, and/or an application 1170. At least a portion of the program module 1110 may be preloaded on an electronic device or may be downloadable from an external electronic device (e.g., the first electronic device 902, the second electronic device 904, the server 906, or the like).

The kernel 1120 (e.g., the kernel 941) may include, for example, a system resource manager 1121 and/or a device driver 1123. The system resource manager 1121 may perform control, allocation, or retrieval of system resources. According to an embodiment, the system resource manager 1121 may include a process managing unit, a memory managing unit, or a file system managing unit. The device driver 1123 may include, for example, a display driver, a camera driver, a Bluetooth driver, a shared memory driver, a USB driver, a keypad driver, a Wi-Fi driver, an audio driver, or an inter-process communication (IPC) driver.

The middleware 1130 may provide, for example, a function that the application 1170 needs in common, or may provide diverse functions to the application 1170 through the API 1160 to allow the application 1170 to efficiently use limited system resources of the electronic device. According to an embodiment, the middleware 1130 (e.g., the middleware 943) may include at least one of a runtime library 1135, an application manager 1141, a window manager 1142, a multimedia manager 1143, a resource manager 1144, a power manager 1145, a database manager 1146, a package manager 1147, a connectivity manager 1148, a notification manager 1149, a location manager 1150, a graphic manager 1151, a security manager 1152, and/or a payment manager 1154, or the like, but is not limited thereto.

The runtime library 1135 may include, for example, a library module that is used by a compiler to add a new function through a programming language while the application 1170 is being executed. The runtime library 1135 may perform input/output management, memory management, or capacities about arithmetic functions.

The application manager 1141 may manage, for example, a life cycle of at least one application of the application 1170. The window manager 1142 may manage a graphic user interface (GUI) resource that is used in a screen. The multimedia manager 1143 may identify a format necessary for playing diverse media files, and may perform encoding or decoding of media files using a codec suitable for the format. The resource manager 1144 may manage resources such as a storage space, memory, or source code of at least one application of the application 1170.

The power manager 1145 may operate, for example, with a basic input/output system (BIOS) to manage the capacity or temperature of a battery or power, and may provide power information for an operation of an electronic device using the corresponding information thereof. The database manager 1146 may generate, search for, or modify database that is to be used in at least one application of the application 1170. The package manager 1147 may install or update an application that is distributed in the form of package file.

The connectivity manager 1148 may manage, for example, wireless connection such as Wi-Fi or Bluetooth. The notification manager 1149 may display or notify an event such as arrival message, appointment, or proximity notification in a mode that does not disturb a user. The location manager 1150 may manage location information about an electronic device. The graphic manager 1151 may manage a graphic effect that is provided to a user, or manage a user interface relevant thereto. The security manager 1152 may provide a general security function necessary for system security, user authentication, or the like. According to an embodiment, in the case where an electronic device (e.g., the electronic device 901) includes a telephony function, the middleware 1130 may further include a telephony manager for managing a voice or video call function of the electronic device.

The middleware 1130 may include a middleware module that combines diverse functions of the above-described elements. The middleware 1130 may provide a module specialized to each OS kind to provide differentiated functions. Additionally, the middleware 1130 may dynamically remove a part of the preexisting elements or may add new elements thereto.

The API 1160 (e.g., the API 945) may be, for example, a set of programming functions and may be provided with a configuration that is variable depending on an OS. For example, in the case where an OS is Android or iOS, it may provide one API set per platform. In the case where an OS is Tizen, it may provide two or more API sets per platform.

The application 1170 (e.g., the application program 947) may include, for example, one or more applications capable of providing functions for a home 1171, a dialer 1172, an SMS/MMS 1173, an instant message (IM) 1174, a browser 1175, a camera 1176, an alarm 1177, a contact 1178, a voice dial 1179, an e-mail 1180, a calendar 1181, a media player 1182, an album 1183, a clock 1184 and/or a payment 1185. Additionally, or alternatively, though not illustrated, various other applications are also possible, such as, for example, and application for offering health care (e.g., measuring an exercise quantity, blood sugar, or the like) or environment information (e.g., information of barometric pressure, humidity, temperature, or the like).

According to an embodiment, the application 1170 may include an application (hereinafter referred to as "information exchanging application" for descriptive convenience) to support information exchange between an electronic device (e.g., the electronic device 901) and an external electronic device (e.g., the first electronic device 902 or the second electronic device 904). The information exchanging application may include, for example, a notification relay application for transmitting specific information to an external electronic device, or a device management application for managing the external electronic device.

For example, the notification relay application may include a function of transmitting notification information, which arise from other applications (e.g., applications for SMS/MMS, e-mail, health care, or environmental information), to an external electronic device. Additionally, the information exchanging application may receive, for example, notification information from an external electronic device and provide the notification information to a user.

The device management application may manage (e.g., install, delete, or update), for example, at least one function (e.g., turn-on/turn-off of an external electronic device itself (or a part of elements) or adjustment of brightness (or resolution) of a display) of the external electronic device which communicates with the electronic device, an application running in the external electronic device, or a service (e.g., a call service, a message service, or the like) provided from the external electronic device.

According to an embodiment, the application 1170 may include an application (e.g., a health care application of a mobile medical device) that is assigned in accordance with an attribute of an external electronic device. According to an embodiment, the application 1170 may include an application that is received from an external electronic device (e.g., the first electronic device 902, the second electronic device 904, or the server 906). According to an embodiment, the application 1170 may include a preloaded application or a third party application that is downloadable from a server. The names of elements of the program module 1110 according to the embodiment may be modifiable depending on kinds of operating systems.

According to various embodiments, at least a portion of the program module 1110 may be implemented by software, firmware, hardware, or any combination of two or more thereof. At least a portion of the program module 1110 may be implemented (e.g., executed), for example, by the processor (e.g., the processor 1010). At least a portion of the program module 1110 may include, for example, modules, programs, routines, sets of instructions, processes, or the like for performing one or more functions.

The term "module" used in this disclosure may refer, for example, to a unit including one or more combinations of hardware, software and firmware. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" may include, for example, and without limitation, at least one of a dedicated processor, a CPU, an application-specific IC (ASIC) chip, a field-programmable gate array (FPGA), and a programmable-logic device for performing some operations, or the like, which are known or will be developed.

At least a part of an apparatus (e.g., modules or functions thereof) or a method (e.g., operations) according to various embodiments may be, for example, implemented by instructions stored in a computer-readable storage media in the form of a program module. The instruction, when executed by a processor (e.g., the processor 920), may cause the one or more processors to perform a function corresponding to the instruction. The computer-readable storage media, for example, may be the memory 930.

A computer-readable recording medium may include a hard disk, a floppy disk, a magnetic media (e.g., a magnetic tape), an optical media (e.g., a compact disc read only memory (CD-ROM) and a digital versatile disc (DVD), a magneto-optical media (e.g., a floptical disk)), and hardware devices (e.g., a read only memory (ROM), a random access memory (RAM), or a flash memory). Also, the one or more instructions may contain a code made by a compiler or a code executable by an interpreter. The above hardware unit may be configured to operate via one or more software modules for performing an operation according to various embodiments, and vice versa.

A module or a program module according to various embodiments may include at least one of the above elements, or a part of the above elements may be omitted, or additional other elements may be further included. Operations performed by a module, a program module, or other elements according to various embodiments may be executed sequentially, in parallel, repeatedly, or in a heuristic method. In addition, some operations may be executed in different sequences or may be omitted. Alternatively, other operations may be added.

According to an example embodiment of the present disclosure, a computer-readable storage medium may store an instruction that, when executed by an electronic device, causes the electronic device to obtain audio input data including a noise signal having an audio feature, to filter the audio input data using a neural network model to generate first audio output data, and to filter the first audio output data without using the neural network model to generate second audio output data. The first audio output data may have a first changed audio feature corresponding to the audio feature, and the second audio output data may have a second changed audio feature corresponding to the audio feature.

According to an example embodiment of the present disclosure, the instruction, when executed by the electronic device, may cause the electronic device to process a part, which corresponds to the noise signal, of the first audio output data to generate the second audio output data.

While the present disclosure has been illustrated and described with reference to various example embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a memory configured to store data corresponding to a neural network model; and a processor electrically connected to the memory, wherein the processor is configured to:

generate a first input signal including a voice signal and a first noise signal;

generate a second input signal including the voice signal and a second noise signal different from the first noise signal;

process the first input signal based at least partly on the neural network model to obtain an output signal;

update at least part of the neural network model based at least in part on a comparison between the output signal and the second input signal, wherein the memory is further configured to store a voice database and a noise database, and wherein the processor is further configured to: obtain the voice signal using the voice database, and obtain the first noise signal and the second noise signal using the noise database.

2. The electronic device of claim 1, wherein the processor is configured to:

extract a feature value of the first input signal and to extract a feature value of the second input signal;

apply the feature value of the first input signal to the neural network model to obtain the output signal; and update the at least part of the neural network model based at least partly on a feature value of the output signal and the feature value of the second input signal.

3. The electronic device of claim 1, wherein the processor is configured to:

perform the comparison using a cost function.

4. The electronic device of claim 1, wherein the processor is configured to:

generate a third input signal including another voice signal different from the voice signal, and the first noise signal; and apply the first input signal and the third input signal to the neural network model as at least part of the processing.

5. The electronic device of claim 4, wherein the processor is configured to:

generate the voice signal; and reduce the generated voice signal to generate the another voice signal.

6. The electronic device of claim 4, wherein the processor is configured to:

extract the feature value of the first input signal and to extract a feature value of the third input signal;

apply the feature value of the first input signal and the feature value of the third input signal to the neural network model to obtain the output signal; and update at least part of the neural network model based at least partly on a feature value of the output signal and the feature value of the second input signal.

7. The electronic device of claim 4, wherein the processor is configured to:

beamform the first input signal and the third input signal to apply the beamformed first input signal and the beamformed third input signal to the neural network model.

8. The electronic device of claim 1, further comprising:

a communication module comprising communication circuitry, wherein the processor is configured to:

transmit the updated data to an external electronic device using the neural network model if a specified condition is satisfied.

* * * * *